US010830515B2

(12) United States Patent
Laughman et al.

(10) Patent No.: US 10,830,515 B2
(45) Date of Patent: Nov. 10, 2020

(54) SYSTEM AND METHOD FOR CONTROLLING REFRIGERANT IN VAPOR COMPRESSION SYSTEM

(71) Applicant: Mitsubishi Electric Research Laboratories, Inc., Cambridge, MA (US)

(72) Inventors: Christopher Reed Laughman, Waltham, MA (US); Hongtao Qiao, Malden, MA (US); Daniel J Burns, Wakefield, MA (US); Scott A Bortoff, Brookline, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 644 days.

(21) Appl. No.: 14/919,013

(22) Filed: Oct. 21, 2015

(65) Prior Publication Data

US 2017/0115043 A1 Apr. 27, 2017

(51) Int. Cl.

*F25B 49/02* (2006.01)
*F25B 45/00* (2006.01)
*F25B 13/00* (2006.01)

(52) U.S. Cl.

CPC ..... *F25B 49/02* (2013.01); *F25B 13/00* (2013.01); *F25B 45/00* (2013.01); *F25B 2341/0662* (2013.01); *F25B 2400/0415* (2013.01); *F25B 2400/16* (2013.01); *F25B 2600/2513* (2013.01);

(Continued)

(58) Field of Classification Search

CPC ..... F25B 49/02; F25B 13/00; F25B 45/00; F25B 2400/16; F25B 2700/15; F25B 2600/2513; F25B 2341/0662; F25B 2400/0415; F25B 2600/2523; F25B 2345/001–004; F25B 2345/006

See application file for complete search history.

(56) References Cited

U.S. PATENT DOCUMENTS 4,365,482 A * 12/1982 Langgard ..... F25B 13/00 62/149
4,554,792 A * 11/1985 Margulefsky ..... F25B 45/00 62/149

(Continued)

FOREIGN PATENT DOCUMENTS

DE 102014000541 A1 7/2015
EP 1300637 A1 4/2003

(Continued)

*Primary Examiner* — Jianying C Atkisson
*Assistant Examiner* — Miguel A Diaz
(74) *Attorney, Agent, or Firm* — Gennadiy Vinokur; James McAleenan; Hironori Tsukamoto

(57) ABSTRACT

A vapor compression system includes a heat transfer system including an arrangement of components moving a refrigerant through a vapor compression cycle to condition a controlled environment and a refrigerant management system including at least one expansion device regulating an amount of the refrigerant in the vapor compression cycle. The vapor compression system also includes a controller including a processor jointly controlling the expansion device and at least one component of the heat transfer system according to a metric of performance of the vapor compression system.

15 Claims, 9 Drawing Sheets

(52) U.S. Cl.
CPC ... *F25B 2600/2523* (2013.01); *F25B 2700/15* (2013.01)

(56) References Cited

U.S. PATENT DOCUMENTS 5,372,013 A * 12/1994 Lau ..... B60H 1/3204 62/174
5,768,902 A * 6/1998 Nonaka ..... F25B 9/006 62/183
5,784,892 A 7/1998 Reedy
5,829,262 A * 11/1998 Urata ..... F25B 9/006 62/174
5,934,094 A * 8/1999 Itoh ..... B60H 1/3205 62/160
7,010,927 B2 3/2006 Lifson et al.
8,793,003 B2 * 7/2014 Laughman ..... F25B 49/02 62/215
8,899,056 B2 12/2014 Kawano et al.
9,182,154 B2 * 11/2015 Burns ..... F25B 1/00
9,534,820 B2 * 1/2017 Burns ..... F25B 49/02
9,796,240 B2 * 10/2017 Brauer ..... B60H 1/005
9,939,185 B2 * 4/2018 Sunderland ..... F25B 49/027
2004/0237578 A1 * 12/2004 Takegami ..... F25B 13/00 62/510
2005/0044865 A1 * 3/2005 Manole ..... F25B 1/10 62/149
2007/0256432 A1 * 11/2007 Zugibe ..... F25B 43/02 62/115
2009/0013700 A1 * 1/2009 Unezaki ..... F25B 9/008 62/77
2009/0199581 A1 * 8/2009 Ushijima ..... F25B 30/02 62/238.7
2009/0260380 A1 * 10/2009 Okamoto ..... F25B 1/10 62/204
2011/0041523 A1 2/2011 Taras et al.
2011/0192176 A1 * 8/2011 Kim ..... F24F 3/065 62/115
2012/0011866 A1 * 1/2012 Scarcella ..... F25B 1/10 62/79
2012/0041608 A1 * 2/2012 Zugibe ..... G06F 17/5068 700/285
2012/0253543 A1 * 10/2012 Laughman ..... F25B 49/02 700/300
2013/0098072 A1 * 4/2013 Choi ..... F25B 13/00 62/77
2013/0186119 A1 * 7/2013 Burns ..... F25B 1/00 62/115
2014/0047852 A1 * 2/2014 Kim ..... F25B 1/06 62/79
2014/0157821 A1 * 6/2014 Schrader ..... F25B 49/02 62/509
2014/0290288 A1 * 10/2014 Burns ..... F25B 49/02 62/115
2015/0267951 A1 * 9/2015 Berg ..... F25B 45/00 62/77
2015/0300713 A1 * 10/2015 Sun ..... F25B 49/022 62/115
2015/0345846 A1 * 12/2015 Kopko ..... F25B 40/04 62/115
2015/0354877 A1 * 12/2015 Burns ..... F25B 49/02 62/115
2015/0377532 A1 * 12/2015 Uselton ..... F25B 45/00 62/77
2016/0370044 A1 * 12/2016 Danov ..... F25B 41/04
2017/0115043 A1 * 4/2017 Laughman ..... F25B 13/00
2017/0130998 A1 * 5/2017 El-Shaarawi ..... F25B 15/06
2017/0131011 A1 * 5/2017 Zugibe ..... F25B 49/02
2017/0314830 A1 * 11/2017 Klemen ..... F25B 9/008
2018/0031282 A1 * 2/2018 Woo ..... F25B 9/008
2018/0356136 A1 * 12/2018 Zhao ..... F25B 41/062
2019/0203999 A1 * 7/2019 Kulankara ..... F25B 41/04
2019/0323749 A1 * 10/2019 Toulouse ..... F25B 49/02

FOREIGN PATENT DOCUMENTS

EP 2679931 A1 * 1/2014 ..... F25B 13/00
WO 2009140370 11/2009
WO 2014092152 A1 6/2014
WO 20150129456 9/2015
WO WO 2017069281 A1 * 4/2017 ..... F25B 13/00

* cited by examiner

SYSTEM AND METHOD FOR CONTROLLING REFRIGERANT IN VAPOR COMPRESSION SYSTEM

FIELD OF THE INVENTION

This invention relates generally to vapor compression systems, and more particularly to controlling refrigerant in a vapor compression system.

BACKGROUND OF THE INVENTION

Vapor compression systems, such as heat pumps, refrigeration and air-conditioning systems, are widely used in industrial and residential applications. Energy efficiency has always been an important consideration for engineers and building owners when designing and operating air-conditioning, refrigeration, and heat pump systems that incorporate vapor compression cycles, due to the duration of operation and total amount of energy consumed over the cooling and heating seasons. Consequently, one goal of system manufacturers is the reduction of the energy consumption of these systems over time and for various possible installations.

Strategies for identifying methods to reduce energy consumption take into account a number of different factors that affect the energy consumption of the system. In general, four different factors affect energy consumption: the system construction (e.g., heat exchangers or the compressor type); the actuator inputs (e.g., the compressor speed or expansion valve orifice size); the boundary conditions (e.g., temperature or relative humidity); and the operating mode (e.g., cooling or heating mode, single or multiple indoor unit operation).

The design of a vapor compression system must therefore take into account these factors meeting requirements for the users' comfort expectations, the electrical or chemical power consumption, and cost of the system.

This pursuit of increased energy efficiency has motivated numerous innovations in the design and construction of vapor compression cycles. In particular, the desire to reduce energy consumption over the many different conditions and loads experienced by the vapor compression system has prompted the gradual and ongoing transition from fixed output actuators, such as constant speed compressors and fixed orifice expansion valves, to variable output actuators, such as variable speed compressors and electronic expansion valves. The use of these variable output actuators provides the system with the ability to adjust and optimize its operation over a range of operating conditions, rather than be constrained to actuators with fixed outputs optimized for a single set of conditions.

Another system variable that affects many different aspects of the operation of the vapor compression system is the amount of the refrigerant in the vapor compression cycle. If the amount of the refrigerant in the vapor compression cycle is not appropriate, then there is a risk that the performance of the vapor compression system will decline. Thus, a number of methods aim to determine the appropriate amount of refrigerant and/or to vary the amount of the refrigerant during an operation of the vapor compression system.

For example, various methods described in, e.g., U.S. Pat. Nos. 7,010,927 and 8,899,056, use a reservoir connected to the other components in the system via a single or multiple solenoid valves to selectively couple a reservoir of the refrigerant to the rest of the cycle to increase or decrease the amount of the refrigerant in the vapor compression cycle. However, there are at least two problems with such architectures. In particular, the location of refrigerant injection in much of the prior art is problematic, as the injection of refrigerant into some components (e.g., the suction port of the compressor) could potentially cause damage. In addition, the operations of the solenoid valves are difficult to control, because the rate of refrigerant injection is strongly dependent upon specific characteristics (discharge coefficients) of the solenoid valves, as well as the thermodynamic variables describing the cycle (temperatures and pressures of the refrigerant in the reservoir and in the adjacent refrigerant lines).

Other prior art, such as U.S. Pat. No. 5,784,892, describes a method for the control the solenoid valves by measuring a number of variables in the system, such as temperatures and pressures, and sequencing these valves with the objective of making these variables equal a set of setpoints. However, the variations between different installed models of vapor compression systems can cause suboptimal energy efficiency for particular models of vapor compression system. Moreover, changes in the vapor compression system over time due to wear and tear of the components can cause values of these setpoints be suboptimal after a long period of operation and normal wear.

Additionally or alternatively, the control of the amount of the refrigerant in the vapor compression cycle using the solenoid valves can result in unexpected deterioration of different components of vapor compression system, such as the compressor. Accordingly, there is a need for different architecture and control of the amount of the refrigerant in the vapor compression cycle.

SUMMARY OF THE INVENTION

It is an object of some embodiments of an invention to provide a system and a method for controlling the operation of a vapor compression system such that heat load requirements of the operation are met and a performance of the system is optimized. It is another object of some embodiments of the invention to provide such a system and a method, such that the control of the vapor compression system including varying the amount of the refrigerant optimizes an operation of the vapor compression system.

It is a further object of some embodiments of this invention to counteract the reduced performance found in most field-installed vapor compression cycles due to small refrigerant leaks that can remain unaddressed for long time. The cumulative effect of these leaks might degrade the performance of the VCS. Moreover, the changes in many of the system parameters over this long time interval can make difficult to discriminate between changes in the energy efficiency due to changes in the refrigerant mass and changes in the energy efficiency for other reasons, such as an accumulation of dirt on the heat exchanger coils.

To that end, some embodiments of the invention include into the vapor compression cycle an additional component that either adds or subtracts refrigerant mass circulating through a subset of components in response to a particular input or set of inputs. While the total amount of refrigerant in the entire system can remain constant, the refrigerant circulating through the compressor, heat exchangers, and expansion device, otherwise known as the "active charge," can vary, as well as the amount of refrigerant located in the new device, called the "stored charge," i.e., a balance of the refrigerant outside of the vapor compression cycle components. This modification changes a system parameter to a control input.

It is another object of some embodiments of the invention to provide such a system and a method that addresses the problem of deterioration of different components of the vapor compression system that result from controlling the amount of the refrigerant in the vapor compression cycle using solenoid valves.

Some embodiments of the invention are based on an understanding that one of the cause for potential deterioration of components of a vapor compression system lies in a discrete nature of the operations of the solenoid valves. Specifically, the discrete operation of the solenoid valves either completely opens the passage of the refrigerant into the vapor compression cycle or completely closes that passage, breaking continuous flow to different components of the vapor compression cycle. Because lubrication oil circulates with the refrigerant throughout the system, the selective coupling of the storage vessel to the rest of the system can result in the accumulation of lubrication oil in the storage vessel. The removal of this lubricant from other components of the cycle, such as the compressor, can cause premature wear.

Accordingly, one embodiment of the invention uses an expansion device for regulating an amount of the refrigerant in the vapor compression cycle. Such an expansion device can enable uninterrupted continuous flow of the refrigerant to the components by moving the refrigerant/oil mixture through a vapor compression cycle to condition a controlled environment. For example, such an uninterrupted flow can be achieved by varying a size of an orifice of the expansion device without reducing the size to the completely closed position. Furthermore, the continuous control of the amount of the refrigerant enabled by the expansion device is better aligned with continuous nature of the operation of the vapor compression system. For example, the amount of the active refrigerant in the vapor compression cycle can be continuously updated to reflect time-varying behavior of the vapor compression system due to variations in the ambient conditions. To that end, the control of continuously varied expansion device is advantageous for regulating the heating or cooling capacity provided by the system.

Another embodiment of the invention is based on the realization that an objective of the control of the vapor compression system is not to optimize the amount of the refrigerant, but to optimize the overall performance of the vapor compression system. For example, the heat transfer performed by vapor compression cycle and fluid flow behavior of the active charge of the refrigerant can be considered together in optimizing the entire operation of the vapor compression system. The optimal value of the amount of the refrigerant can therefore be related to a large set of system inputs and boundary conditions, such as the outdoor air temperature, the indoor air temperature, the compressor speed, the expansion valve orifice size, and the fan speeds, as well as many other parameters of the system construction.

To that end, some embodiments determine the amount of the refrigerant in the vapor compression cycle not by a separate optimization routine, but as part of a global optimization method that jointly optimizes the amount of the refrigerant and other control parameters, such as speed of the compressor, to achieve performance objectives, such as regulating room temperature to a setpoint or minimizing electrical power consumption. To that end, the expansion device for continuously regulating an amount of the refrigerant in the vapor compression cycle allows to properly react to the requirements of joint optimization.

Accordingly, one embodiment discloses a vapor compression system (VCS), including a heat transfer system including an arrangement of components moving a refrigerant through a vapor compression cycle to condition a controlled environment; a refrigerant management system including at least one expansion device regulating an amount of the refrigerant in the vapor compression cycle; and a controller including a processor jointly controlling the expansion device and at least one component of the heat transfer system according to a metric of performance of the vapor compression system.

Another embodiment discloses a vapor compression system (VCS) including a heat transfer system moving a refrigerant through a vapor compression cycle to condition a controlled environment. The heat transfer system includes a variable speed compressor for compressing the refrigerant; a first heat exchanger and a second heat exchanger for transferring heat in the controlled environment; and a first expansion device regulating a pressure drop between the first and the second heat exchangers; and a refrigerant management system continuously regulating an amount of the refrigerant in the vapor compression cycle. The refrigerant management system includes a storage vessel storing a balance of the refrigerant outside of the vapor compression cycle; a second expansion device controlling a flow of the refrigerant from the vapor compression cycle into the storage vessel; and a third expansion device controlling a flow of the refrigerant from the storage vessel into the vapor compression cycle. The VCS also includes a controller jointly controlling operations of the compressor, the first and the second heat exchangers, and the first, the second and the third expansion devices.

Yet another embodiment discloses a method for controlling an operation of a vapor compression system (VCS) including a heat transfer system moving a refrigerant through a vapor compression cycle to condition a controlled environment and at least one expansion device regulating an amount of the refrigerant in the vapor compression cycle. The method includes determining control inputs defining a size of an orifice of the expansion device and a parameter of an operation of the component of the heat transfer system, such that joint operation of the expansion device and the component of the heat transfer system optimizes an energy consumption of the VCS; and controlling the VCS using the control inputs, wherein steps of the method are performed by a processor.

Definitions

In describing embodiments of the invention, the following definitions are applicable throughout (including above).

A "vapor compression system" refers to a system that uses the vapor compression cycle to move refrigerant through components of the system based on principles of thermodynamics, fluid mechanics, and/or heat transfer. The vapor compression systems can be, but are not limited to, a heat pump, refrigeration, and an air-conditioner system. Vapor compression systems are used in applications beyond the conditioning of residential or commercial spaces. For example, vapor compression cycles can be used to cool computer chips in high-performance computing applications.

An "HVAC" system refers to any heating, ventilating, and air-conditioning (HVAC) system implementing the vapor compression cycle. HVAC systems span a very broad set of systems, ranging from systems which supply only outdoor air to the occupants of a building, to systems which only control the temperature of a building, to systems which control the temperature and humidity.

"Components of a vapor compression system" refer to any components of the vapor compression system having an operation controllable by the control systems. The components include, but are not limited to, a compressor having a variable speed for compressing and pumping the refrigerant through the system; an expansion valve for providing an adjustable pressure drop between the high-pressure and the low-pressure portions of the system, and an evaporating heat exchanger and a condensing heat exchanger, each of which incorporates a variable speed fan for adjusting the air-flow rate through the heat exchanger.

An "evaporator" refers to a heat exchanger in the vapor compression system in which the refrigerant passing through the heat exchanger evaporates over the length of the heat exchanger, so that the specific enthalpy of the refrigerant at the outlet of the heat exchanger is higher than the specific enthalpy of the refrigerant at the inlet of the heat exchanger, and the refrigerant generally changes from a liquid to a gas. There may be one or more evaporators in the vapor compression system.

A "condenser" refers to a heat exchanger in the vapor compression system in which the refrigerant passing through the heat exchanger condenses over the length of the heat exchanger, so that the specific enthalpy of the refrigerant at the outlet of the heat exchanger is lower than the specific enthalpy of the refrigerant at the inlet of the heat exchanger, and the refrigerant generally changes from a gas to a liquid. There may be one or more condensers in a vapor compression system.

The "refrigerant charge" refers to the total refrigerant mass contained in a vapor compression system. In considering vapor compression systems in which some of the refrigerant is sequestered in a receiver or other storage vessel, the "active charge" refers to the possibly time-varying sum of all of the refrigerant mass circulating through the system's components, such as the compressor and heat exchangers, and the "stored charge" refers to the possibly time-varying mass of refrigerant contained in the receiver or other storage vessel.

"Set of control signals" refers to specific values of the inputs for controlling the operation of the components of the vapor compression system. The set of control signals includes, but is not limited to, values of the speed of the compressor, the position of the expansion valve, the speed of the fan in the evaporator, and the speed of the fan in the condenser.

A "setpoint" refers to a target value of the system, such as the vapor compression system, aim to reach and maintain as a result of the operation. The term setpoint is applied to any particular value of a specific set of control signals and thermodynamic and environmental parameters.

A "computer" refers to any apparatus that is capable of accepting a structured input, processing the structured input according to prescribed rules, and producing results of the processing as output. Examples of a computer include a general-purpose computer; a supercomputer; a mainframe; a super mini-computer; a mini-computer; a workstation; a microcomputer; a server; an interactive television; a hybrid combination of a computer and an interactive television; and application-specific hardware to emulate a computer and/or software. A computer can have a single processor or multiple processors, which can operate in parallel and/or not in parallel. A computer also refers to two or more computers connected together via a network for transmitting or receiving information between the computers. An example of such a computer includes a distributed computer system for processing information via computers linked by a network.

A "central processing unit (CPU)" or a "processor" refers to a computer or a component of a computer that reads and executes software instructions.

A "memory" or a "computer-readable medium" refers to any storage for storing data accessible by a computer. Examples include a magnetic hard disk; a floppy disk; an optical disk, like a CD-ROM or a DVD; a magnetic tape; a memory chip; and a carrier wave used to carry computer-readable electronic data, such as those used in transmitting and receiving e-mail or in accessing a network, and a computer memory, e.g., random-access memory (RAM).

"Software" refers to prescribed rules to operate a computer. Examples of software include software; code segments; instructions; computer programs; and programmed logic. Software of intelligent systems may be capable of self-learning.

A "module" or a "unit" refers to a basic component in a computer that performs a task or part of a task. It can be implemented by either software or hardware.

A "control system" refers to a device or a set of devices to manage, command, direct or regulate the behavior of other devices or systems. The control system can be implemented by either software or hardware, and can include one or several modules. The control system, including feedback loops, can be implemented using a microprocessor. The control system can be an embedded system.

DETAILED DESCRIPTION OF EMBODIMENTS OF INVENTION

Figure 1:
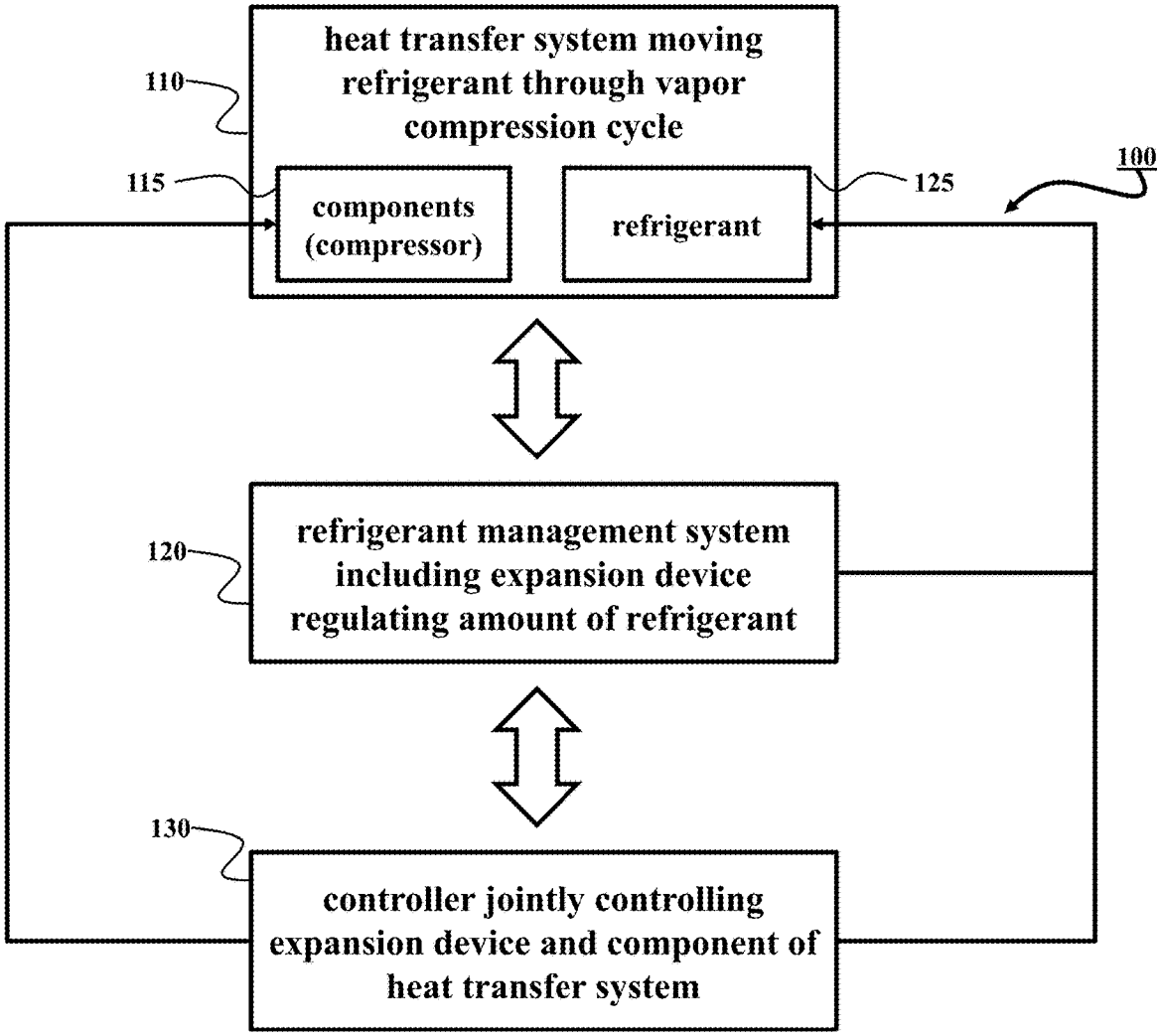
FIG. 1 is a block diagram of a vapor compression system (VCS) according to one embodiment of an invention.

FIG. 1 shows a block diagram of a vapor compression system (VCS) 100 according to one embodiment of an invention. The VCS 100 includes a heat transfer system 110 having an arrangement of components 115 moving a refrigerant through a vapor compression cycle to condition a controlled environment. For example, the components 115 can include one or combination of a variable speed compressor for compressing the refrigerant; heat exchangers for transferring the heat in the controlled environment; and an expansion device regulating a pressure drop between the heat exchangers.

The VCS 100 includes a refrigerant management system 120 including at least one expansion device regulating an amount of the refrigerant in the vapor compression cycle. For example, in one embodiment, the refrigerant management system includes at least two expansion devices. For example, one expansion device can control a flow of the refrigerant from the vapor compression cycle into the storage vessel storing a balance of the refrigerant outside of the vapor compression cycle, and another expansion device can control a flow of the refrigerant from the storage vessel back into the vapor compression cycle.

The expansion device of the refrigerant management system 120 can enable uninterrupted continuous flow of the refrigerant to the components of the heat transfer system 110. Such a continuous flow enables uninterrupted supply of lubrication oil to the components that can prolong their lifespan.

The VCS 100 includes a controller 130 jointly controlling the expansion device of the refrigerant management system 120 and at least one component of the heat transfer system according to a metric of performance of the vapor compression system. The controller 130 can be implemented using a processor configured to execute instructions to perform such a control. For example, the processor can be configured to jointly optimize and update a speed of the compressor and a size of an orifice of the expansion device to improve an operation of the VCS according to the metric of performance.

As used herein, the joint control of the expansion device and at least one component of the heat transfer system determines the values of the control inputs for the expansion device and the component in tandem because of their interdependence. This embodiment of the invention is based on a realization that an objective of the control of the vapor compression system is not to optimize the amount of the refrigerant, but to optimize the overall performance of the vapor compression system. To that end, the amount of the refrigerant (active charge) needs to be determined not in isolation, based on, e.g., a mode of operation of the VCS, but together with control parameters of other components of the VCS. For example, if the component is a variable speed compressor, an updated value of the compressor speed can lead to an updated value of the amount of the active refrigerant in the vapor compression cycle. For example, one embodiment uses this joint control to optimize the amount of the refrigerant for a specific value of the speed of the compressor to reduce the energy consumption of the VCS.

The continuous control of the amount of the refrigerant enabled by the expansion device can better aligned with continuous nature of the operation of the VCS. For example, the amount of the active refrigerant in the vapor compression cycle can be continuously updated to reflect time-varying behavior of the vapor compression system due to variations in the ambient conditions. To that end, the control of continuously varied expansion device is advantageous for regulating the heating or cooling capacity provided by the system.

Figure 2:
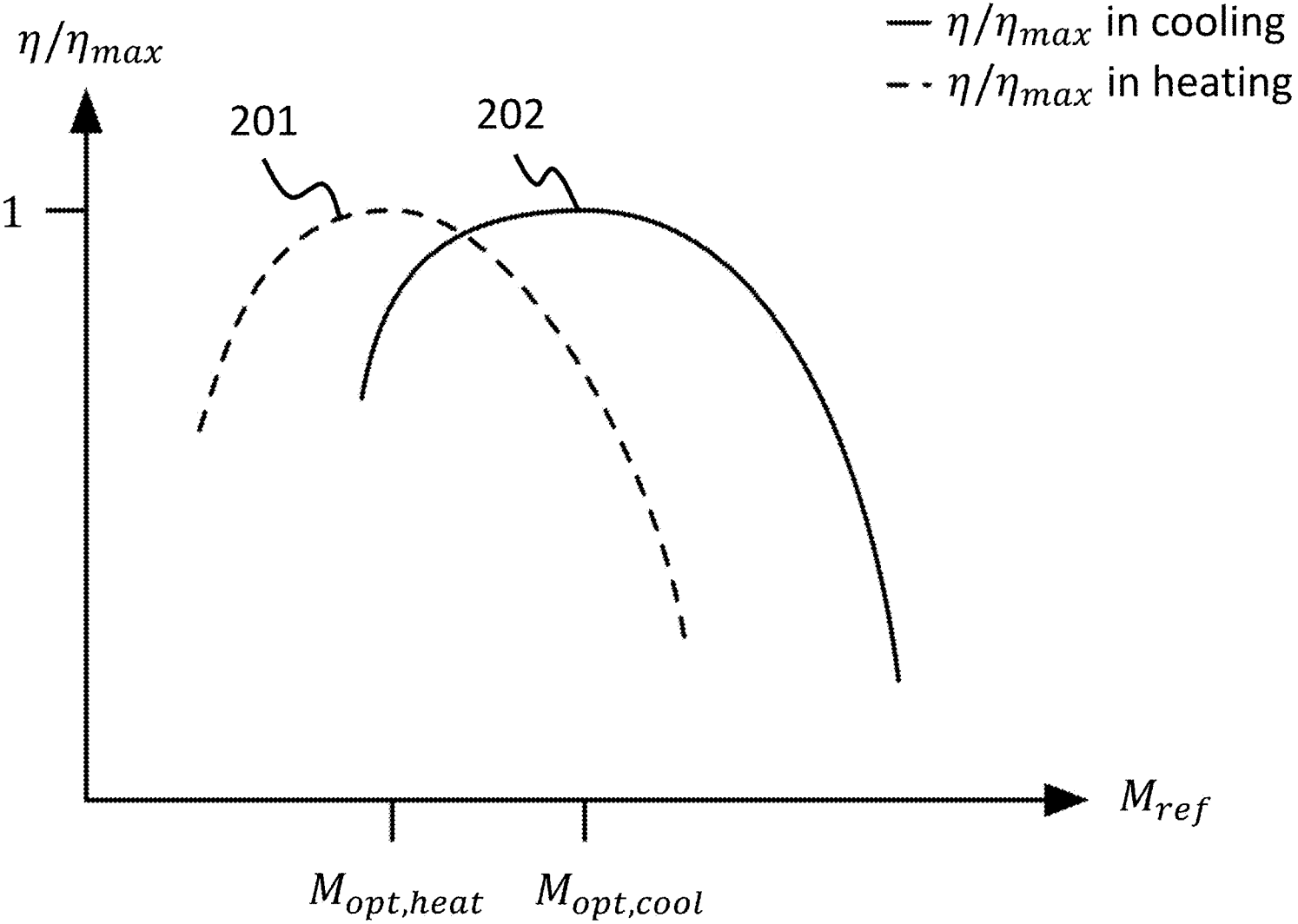
FIG. 2 is a plot illustrating a continuous nature of the dependency of efficiency of the VCS on an amount of the refrigerant in the vapor compression cycle employed by some embodiment of the invention.

FIG. 2 shows a plot illustrating a continuous nature of the dependency of efficiency of the VCS on an amount of the active refrigerant in the vapor compression cycle employed by some embodiment of the invention. At a given set of conditions, the energy efficiency of VCS is sensitive to the amount of refrigerant in the cycle. FIG. 2 shows the variation in the scaled efficiency $\eta/\eta_{max}$ as the active cycle charge $M_{ref}$ is varied. In this figure, the metric $\eta/\eta_{max}$ is used because the peak efficiency $\eta_{max}$ is different between cooling mode and heating mode. As shown in the FIG. 2, the optimum cycle charge $M_{opt,heat}$ for heating mode (201) is different than the optimum cycle charge $M_{opt,cool}$ in cooling mode (202), and the selection of a single value of the cycle charge will result in suboptimal cycle charge in other operating modes. These variations are also similar to variations in the efficiency of the cycle as a function of the cycle charge for different outdoor air temperatures or relative humidities, for example.

The differences between the values of the optimal active charge for different operating modes or conditions are a significant consideration in determining the amount of the refrigerant in the vapor compression cycle. Notably, however, the efficiency of the VCS continuously depends on the amount of the refrigerant regardless of the mode of operation. To that end, some embodiments continuously vary the amount of active charge, as contrasted with discrete operation of the solenoid valves.

Figure 3:
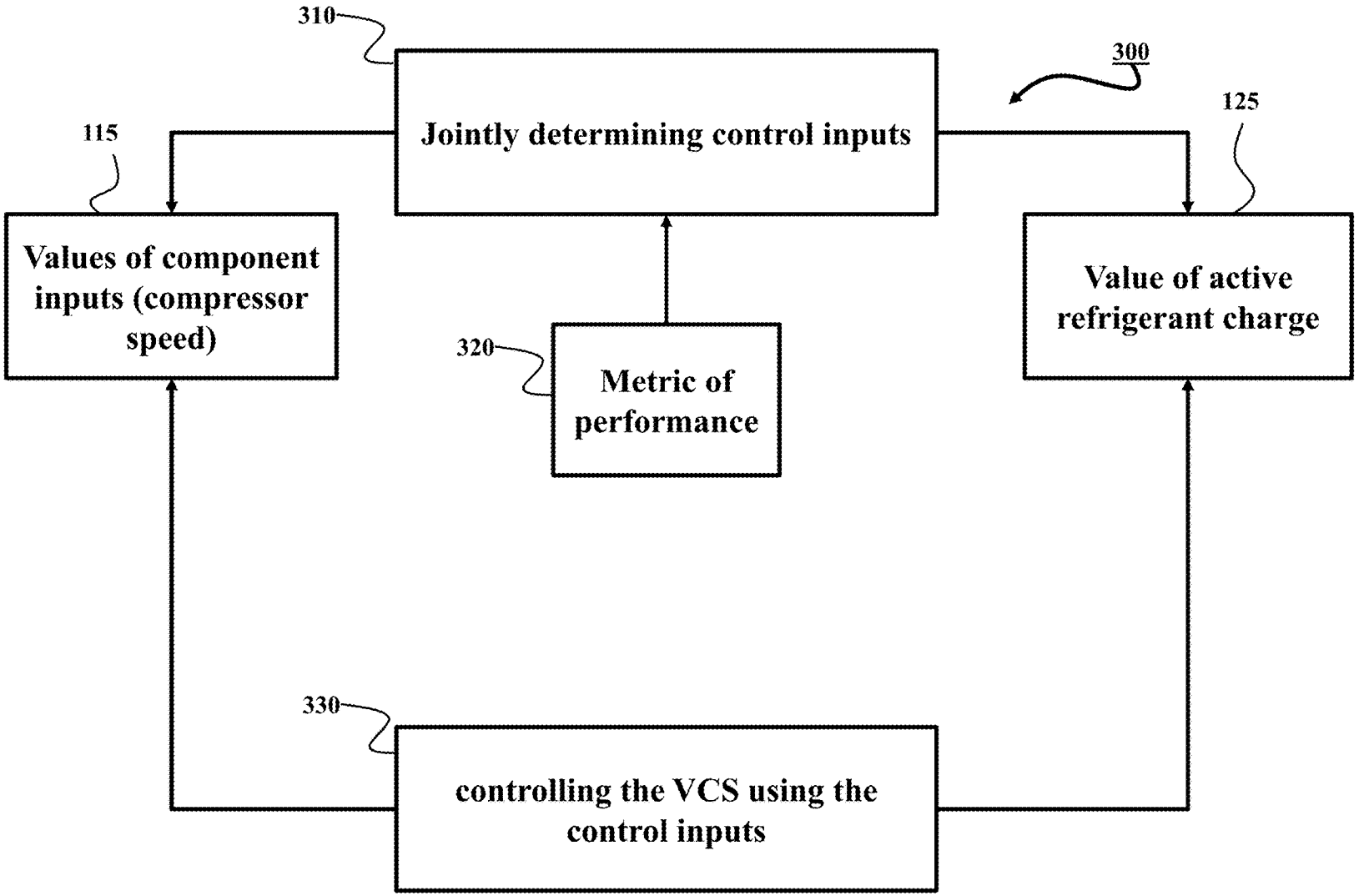
FIG. 3 is a block diagram of a method for controlling an operation of the VCS shown in FIG. 1.

FIG. 3 shows a block diagram of a method 300 for controlling an operation of the VCS shown in FIG. 1. Steps of the method can be performed by a processor, e.g., by the processor of the controller 130. The method 300 determines the amount of the active refrigerant charge as part of global optimization method that jointly optimizes the amount of the refrigerant and the values of other control parameters, such as speed of the compressor.

The method determines 310 control inputs for the expansion device of the refrigerant management system and the components of the heat transfer system such that the combination of the control inputs results in the operation of the VCS that optimizes the metric of performance 320, e.g., an energy consumption of the VCS. For example, the control inputs can define a size of an orifice of the expansion device and a parameter of an operation of the component of the heat transfer system. Next, the method controls 330 the VCS using the control inputs.

Figure 4:
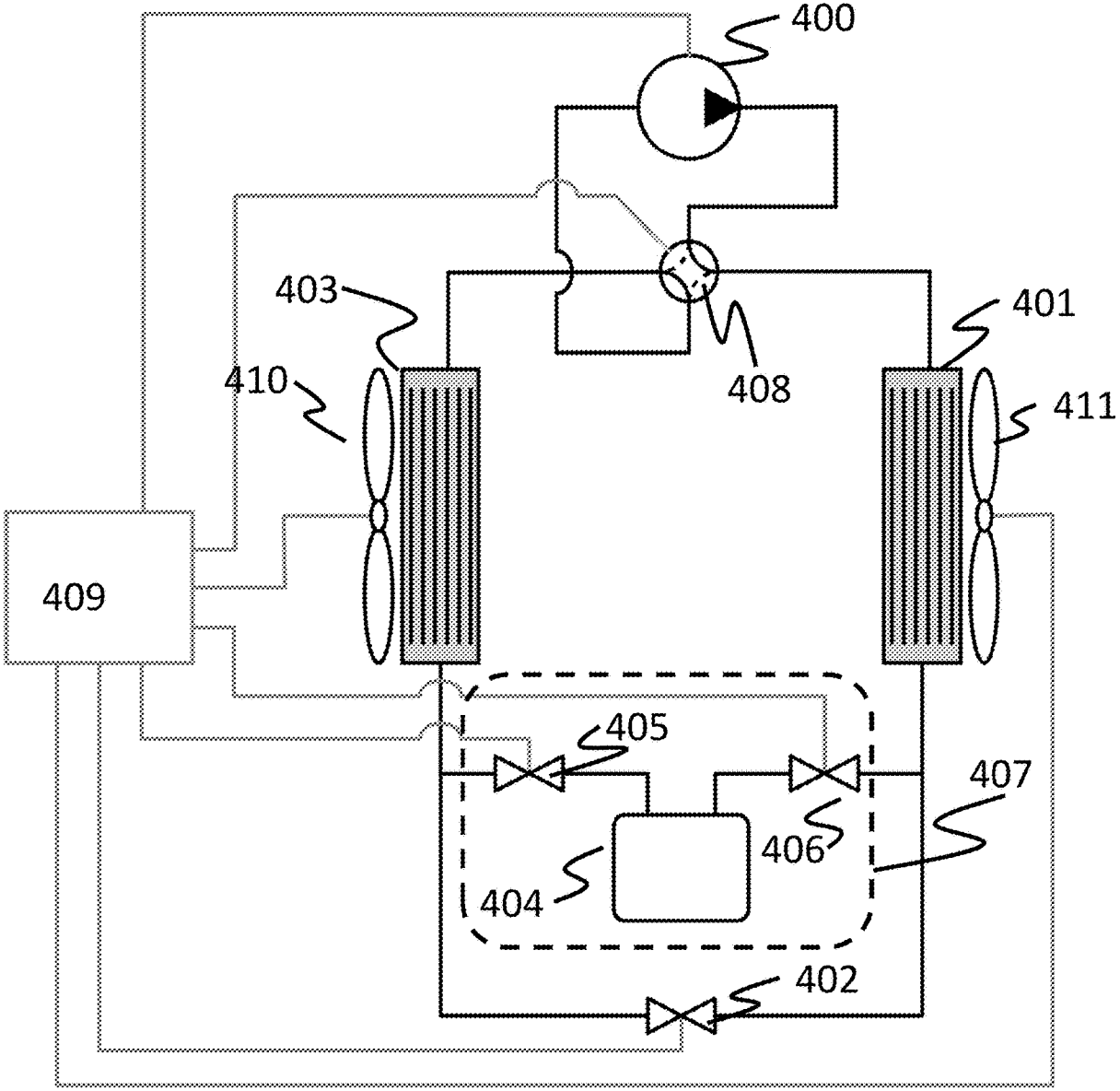
FIG. 4 is a block diagram of the VCS according to one embodiment of the invention.

FIG. 4 shows a block diagram of the VCS according to one embodiment of the invention. In this embodiment, the arrangement of the components of the heat transfer system includes a compressor 400, e.g., a variable speed compressor for compressing the refrigerant; an outdoor heat exchanger 401 and an indoor heat exchanger 403 for transferring heat in the controlled environment; and an expansion device 402 regulating a pressure drop between the heat exchangers 401 and 403. The heat transfer over the heat exchangers can be enhanced with the fans 410 and 411.

In this embodiment, the refrigerant management system 120 is implemented as the system 407 that includes a storage vessel 404 storing a balance of the refrigerant outside of the vapor compression cycle, an expansion device 406 controlling a flow of the refrigerant from the vapor compression cycle into the storage vessel, and an expansion device 405 controlling a flow of the refrigerant from the storage vessel into the vapor compression cycle. In one embodiment, the expansion devices 405, 406 are electronically actuated expansion devices. While this system is nominally illustrated as operating in cooling mode, the reversing valve 408 can be actuated to change the operation to the heating mode. This VCS also includes a controller, e.g., the controller 409, which continuously optimizes the performance of the overall system by simultaneously and concurrently controlling all actuators.

When the VCS is in steady-state, the expansion devices 405 and 406 are at constant, but not necessarily equal positions. During the steady-state, the amount of refrigerant in the storage vessel 404 can also be constant when the mass flow rate of refrigerant entering the storage vessel is identical to the mass flow rate of refrigerant leaving the storage vessel. By modulating the mass flow rates of refrigerant into and out of the storage vessel, the amount of refrigerant in the vessel can either be increased or decreased, depending on the requirements for the VCS.

Similarly, under steady-state operating conditions, the controller can operate the actuators 400, 402, 405, 406, 408, 410, 411 using the control inputs with the constant values. In this situation, the mass flow rate of refrigerant $\dot{m}_{comp}$ through the compressor can be sufficient to provide the proper cooling capacity out of the evaporating heat exchanger 403, and the fans 410 and 411 set the heat transfer coefficient for both the condensing heat exchanger 401 and the evaporating heat exchanger 403. The mass flow rate $\dot{m}_{comp}$ is equal to the sum of the mass flow rate of refrigerant $\dot{m}_{DR}$ through the expansion devices 405 and 406 and the mass flow rate of refrigerant ($\dot{m}_{LEV1}$) through LEV1 402, which are controlled to maintain the proper pressure drop and mass flow rate through the system and to maintain the proper active charge in the cycle $M_{active}$ and the corresponding remainder which is the difference between the total amount of charge in the cycle $M_{total}$ and the amount in the storage vessel (404) $M_{DR}=M_{total}-M_{active}$. The circulation of refrigerant into and out of the storage vessel 404 is also important from the perspective of the lubrication oil circulating through the VCS. Because the refrigerant/oil mixture is continuously circulating through the vessel, it is much less likely that oil accumulates in the vessel and deprives other components (e.g., the compressor) of much-needed lubrication.

In this steady-state operation, the controller 409 regulates a number of process variables. In one embodiment, the controller regulates the temperature of the air exiting the evaporator, the evaporator superheat temperature of the refrigerant (e.g., the difference of the refrigerant temperature leaving the evaporator and the boiling refrigerant temperature at the evaporator pressure), the condenser subcooling temperature of the refrigerant (e.g., the difference of the refrigerant temperature leaving the condenser and the condensing refrigerant temperature at the condenser pressure), and the power consumption of the system. This controller may simultaneously control the temperatures to a set of identified setpoints, and also use an adaptive control law (e.g., extremum seeking) to minimize the power consumption of the system by choosing the appropriate $M_{active}$.

While the above operation holds when the VCS is in steady-state operation, such a condition is rarely attained in practice. More commonly, many of the variables that affect the system operation are time-varying, and cause the initial choice of $M_{active}$ to suboptimal over much of the observed range of operating conditions. Moreover, switches in the operating mode also require adjustments in $M_{active}$ to maintain optimal energy efficiency. As a result, the active charge $M_{active}$ varies over time to maintain the optimal charge for the time-varying set of conditions.

In the case where the controller determines that $M_{active}$ needs to be increased to reduce the power consumption of the system, the expansion devices 405 and 406 are actuated in such a way that the refrigerant mass flow rate into the storage vessel 404 is lower than the refrigerant mass flow rate out of the storage vessel. For example, one embodiment increases the orifice size for expansion device 405 to increase the mass flow rate out of the storage vessel, and decreasing the orifice size for expansion device 406 to reduce the mass flow rate into the storage vessel. These changes in the mass flow rate through the expansion devices may also change the behavior of other variables in the system, requiring adjustment in the other actuators (particularly the compressor speed and the position of $LEV_1$) to maintain the required performance.

In the alternative case where the controller determines that $M_{active}$ needs to be decreased to reduce the power consumption of the overall systems, expansion devices 405 and 406 can be actuated in a manner opposite to that which was done to add charge. For example, one embodiment decreases the orifice size for expansion device 405 to reduce the mass flow rate out of the storage vessel, and increasing the orifice size for expansion device 406 to increase the mass flow rate into the storage vessel. As before, these changes can be accompanied by simultaneous changes to other actuators to maintain the regulated variables at their specified setpoints.

Figure 5:
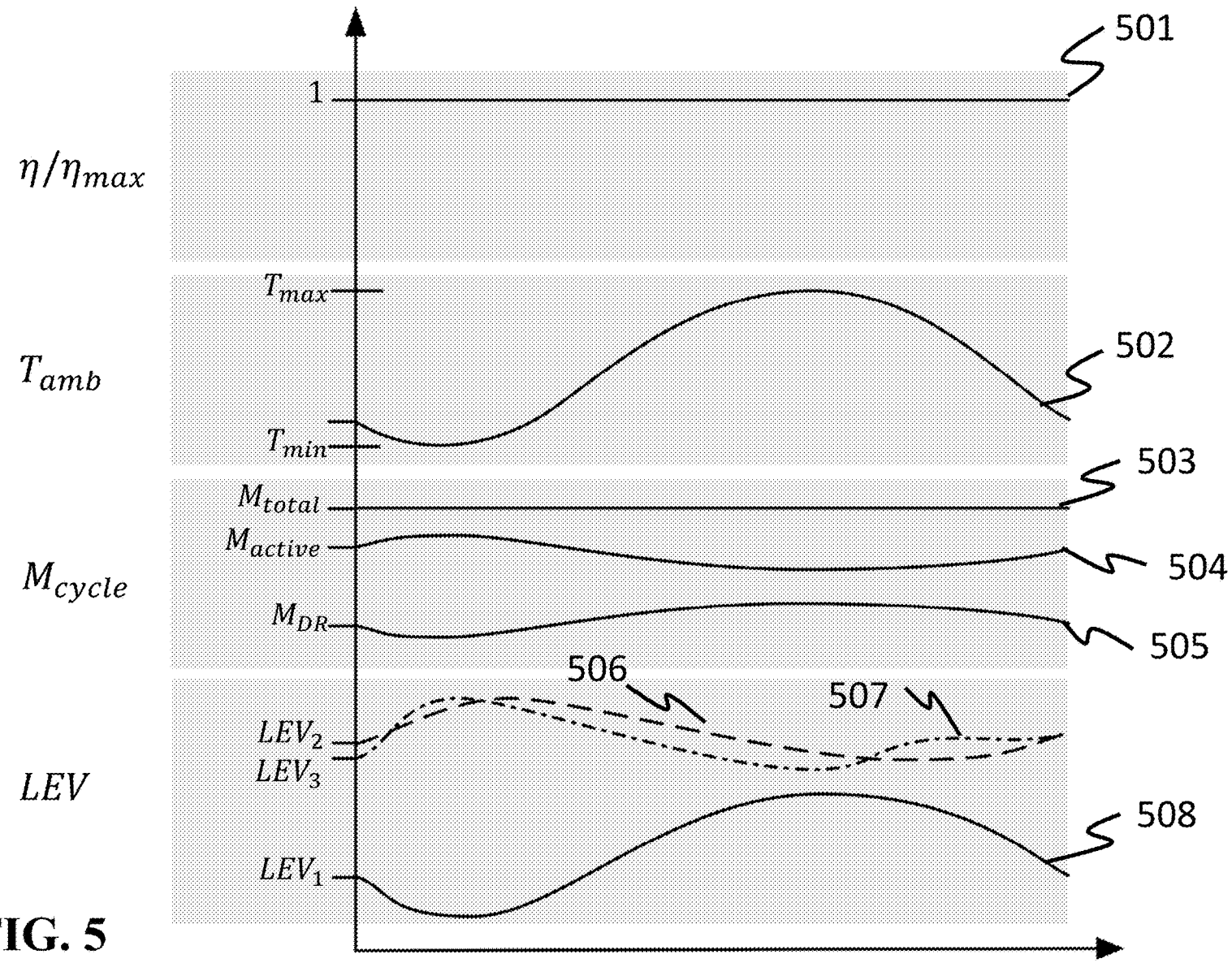
FIG. 5 is a timing diagram illustrating the time-varying behavior of a number of representative variables describing the operation of the VCS in a transient mode according to one embodiment of the invention.

FIG. 5 shows a schematic illustrating the time-varying behavior of a number of representative variables describing the operation of the VCS in a transient mode according to one embodiment of the invention. In this embodiment, the VCS is operating in the cooling mode while the ambient temperature 502 varies between temperature $T_{min}$ and $T_{max}$. The VCS controls the actuators to maintain the cooling capacity and/or temperature in the control environment and to minimize the power consumption. The waveforms 506 and 507 represent the orifice size for the two expansion devices (referred to here as $LEV_2$ and $LEV_3$), and vary with the changes in the ambient temperature 502 to optimize $M_{active}$ (504) for the operating conditions. As described above, $M_{active}$ 504 and the corresponding remainder $M_{DR}$ 505 results in the total amount of charge in the cycle $M_{total}$ 503, such that $M_{DR}=M_{total}-M_{active}$. The orifice size of $LEV_3$ (represented in FIG. 4 by element 405), visible as trace 507 in FIG. 5, spends the predominant amount of time closing down more than $LEV_2$ (represented in FIG. 4 by element 406), which is visible at trace 506.

In this example, the mass flow rate into the storage vessel is greater than the mass flow rate out of the storage vessel, allowing the total refrigerant mass contained in the vessel to increase over time and reduce the active charge in the cycle. These changes in the two expansion devices represent a disturbance to the other actuators in the system, such as $LEV_1$508 (represented in FIG. 4 by element 402), and the parameters of these actuators are also changed accordingly to maintain the performance of the VCS. However, by designing a controller that can jointly optimize the full set of control variables (including $M_{active}$), the embodiments are able to reduce the power consumption over the range of operating conditions so that the system efficiency (501) is optimized.

Figure 6:
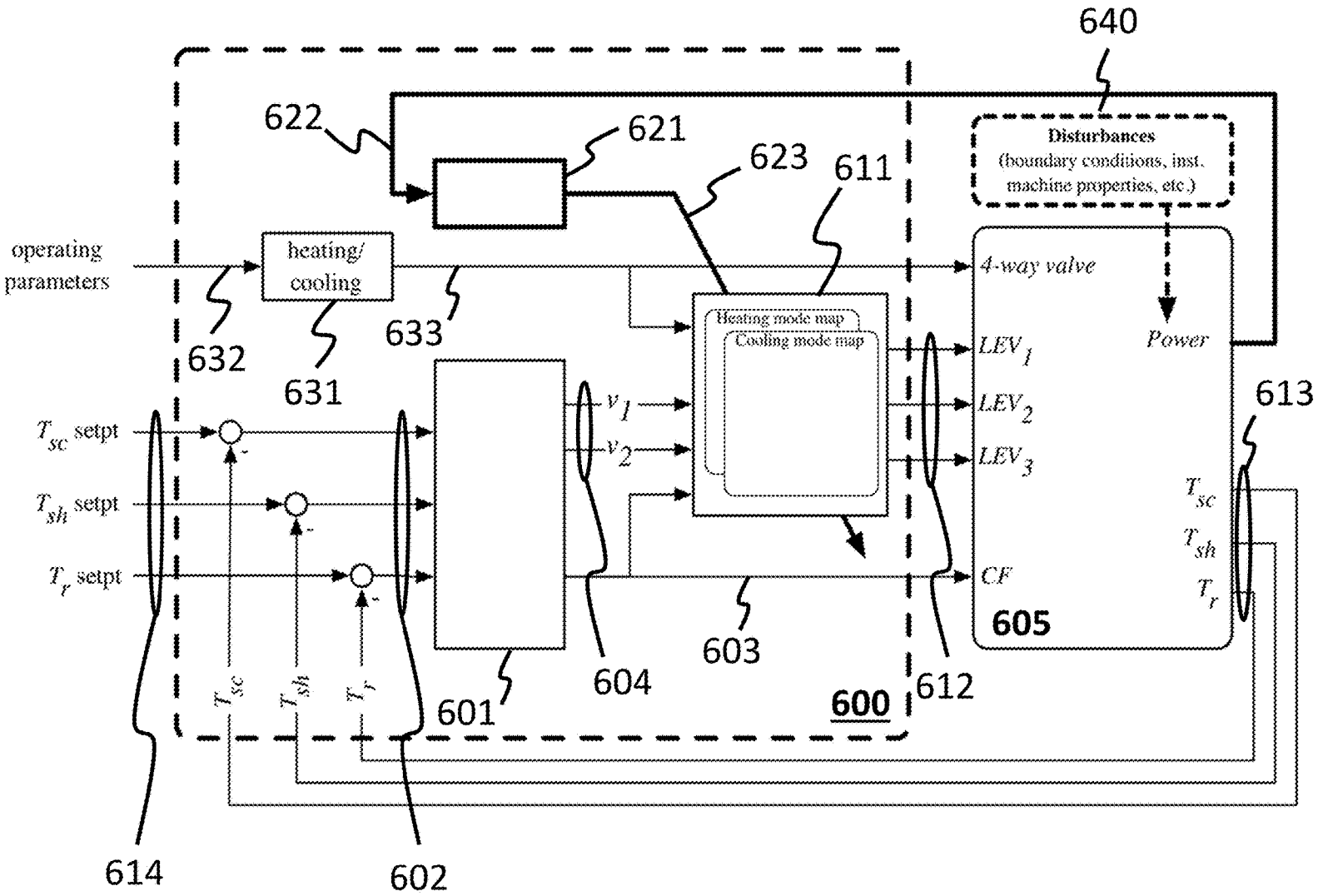
FIG. 6 is a schematic diagram of a controller of the VCS according to one embodiment of the invention.

FIG. 6 shows a block diagram of a controller 600 of one embodiment that jointly determines actuator commands that simultaneously meets the temperature requirement and optimizes the amount of refrigerant mass circulating in the vapor compression cycle 605. Because the measuring or estimating refrigerant mass is difficult, the controller 600 optimizes the amount of refrigerant through indirect means in one embodiment. For example, the effect of refrigerant mass is detected through the power consumption, and a model-free self-optimizing algorithm adjusts parameters of the feedback controller that modulate the commands to the expansion devices on either side of the storage vessel. In this manner, the power consumption is driven to a minimum value by adjusting valves that control the unmeasured circulating refrigerant mass.

The controller 600 includes a feedback regulator 601, a set of lookup tables and/or a function 611 providing mappings from virtual signals to expansion device commands, and a self-optimizing controller 621 that adjusts 623 the function. The feedback regulator receives error signals 602 representing the differences between desired setpoints 614 such as a desired room temperature setpoint, and measurements 613 of the corresponding signals. The feedback regulator is designed to select actuator commands such that the error signals are driven to zero. The actuator commands output from the feedback regulator can include direct commands to physical actuators such as a compressor frequency command 603 and/or commands to virtual actuators 604 that do not directly represent physical actuators.

The virtual actuators can be understood as follows. Consider replacing both the expansion device 402 and the refrigerant management system 407 with a single virtual expansion device. Then a virtual command output from the feedback regulator can represent the commanded orifice opening of this lumped virtual actuator.

The virtual commands are provided to the function 611 that maps the virtual commands 604 to control inputs 612 to the actuators of the VCS 605. There can be different mappings for different operating modes such as a mapping for operation in cooling mode and another mapping for operation in heating mode, and therefore the function 611 can receive information 633 indicative of the operating 632 heating/cooling mode 631 in order to select the corresponding mapping. The mapping converts the commands for virtual actuators to commands to physical actuators according to the following algebraic relationships:

$$v_1 = \frac{k_1 LEV_1 (LEV_2 + LEV_3)}{LEV_1 + k_1 (LEV_2 + LEV_3)},$$

$$v_2 = LEV_3 - k_2 LEV_2,$$

where the first equation can be interpreted as the parallel connection of an expansion device 402 with a refrigerant management system 407, and the second relationship indicates the relative opening of the inlet 406 and outlet 405 expansion devices and therefore controls the retained refrigerant mass in the storage vessel 404.

The mapping parameters $k_1$ and $k_2$ are adjusted by the self-optimizing controller 621 in order to minimize the measured power consumption. The power consumption 622 of the vapor compression machine is influenced by many disturbances 640 that may or may not be measured. The disturbances 640 include machine properties such as the mass of refrigerant circulating in the machine (among many other properties). Therefore, by appropriately adjusting the mapping parameters $k_1$ and $k_2$, the expansion valves for the storage vessel are controlled in such a way as to adjust the circulating refrigerant mass such that the power consumption is minimized, without requiring a direct measurement of refrigerant mass.

In one embodiment, the self-optimizing controller 621 is implemented as an extremum seeking controller that performs optimization by model-free gradient descent. In this embodiment, the parameters $k_1$ and $k_2$ are iteratively and simultaneously modulated such that the power consumption is driven to a minimum value.

In some embodiments, the controller preserves rapid responses to disturbances that occur on the minute-by-minute timescale, including refrigerant mass modulation. For example, the feedback regulator can be configured to compute commands at a timescale on the order as the dominant vapor compression machine dynamics in order to ensure good room temperature regulation performance. Because the mappings are algebraic and require relatively few computations, all actuator commands are computed rapidly. Furthermore, the mappings can be updated by the self-optimization controller concurrently with operation of the feedback regulator so optimal power consumption is tracked as the time-varying disturbances change.

One benefit of some embodiments of the invention is in reducing the energy consumption of the overall system by continuously and precisely optimizing the active charge in the cycle through actuation of the expansion devices. However, different embodiments have a number of other distinct advantages. For example, one embodiment can reduce the time required to successfully commission an VCS based on the vapor compression cycle by freeing the technician from the laborious tuning of the refrigerant mass, e.g., only an approximate value of charge have to be used and the controller of the VCS tunes the active charge to achieve optimal performance. The vapor compression cycle can also be less susceptible to degraded energy performance due to refrigerant leak faults because the extra refrigerant included in the storage vessel can compensate for a certain amount of the lost refrigerant. One embodiment can partially compensate for typical system performance degradation that results from gradual aging, such as the reduction in heat transfer coefficients from unclean surfaces. Also, some embodiments ensure that the compressor lubricant is able to circulate effectively throughout the system, because the refrigerant management system is continuously connected to the rest of the active cycle.

Figure 7:
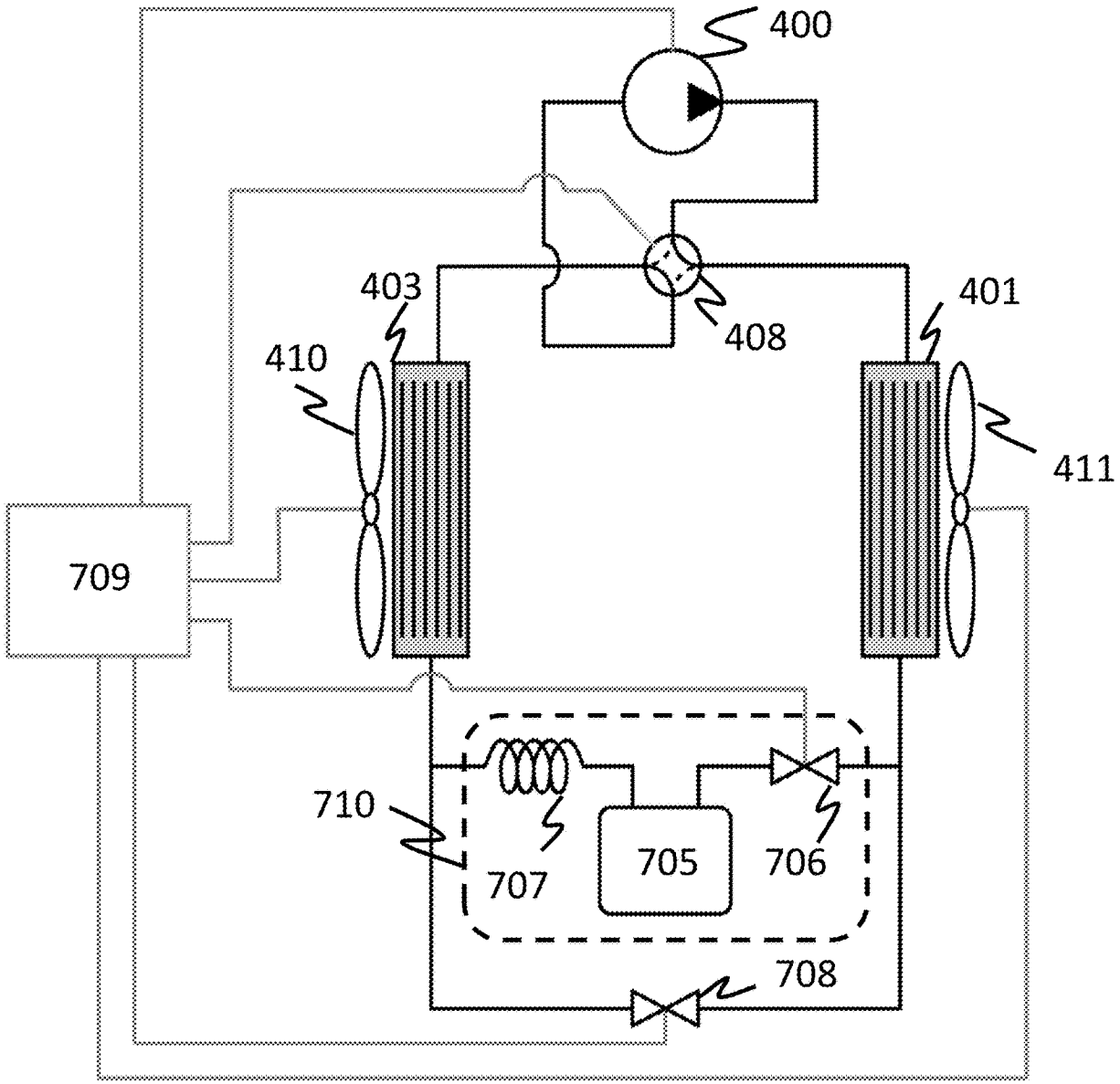
FIGS. 7, 8 and 9 are block diagram of the VCS according to different embodiments of the invention.

FIG. 7 shows a block diagram of the VCS including a refrigerant management system 710 according to another embodiment of the invention. In this embodiment, the variable position expansion device 405 of FIG. 4 is replaced with a fixed orifice expansion device 707, while an expansion device 708 regulating a pressure drop between the heat exchangers 401 and 403. In this embodiment, the fixed orifice expansion device 707 is not actively controlled, so that the variable position expansion device 706 changes its position to affect the pressure drop and flow rate relative to the flow characteristic of the fixed orifice expansion device. In this embodiment, the size of the orifice of the expansion device 707 is fixed in an open position, such that the controller 709 changes the size of the orifice of the expansion device 706 to regulate the amount of refrigerant. Such a modification can be useful due to the reduced cost of a fixed orifice expansion device relative to a variable position expansion device.

Figure 8:
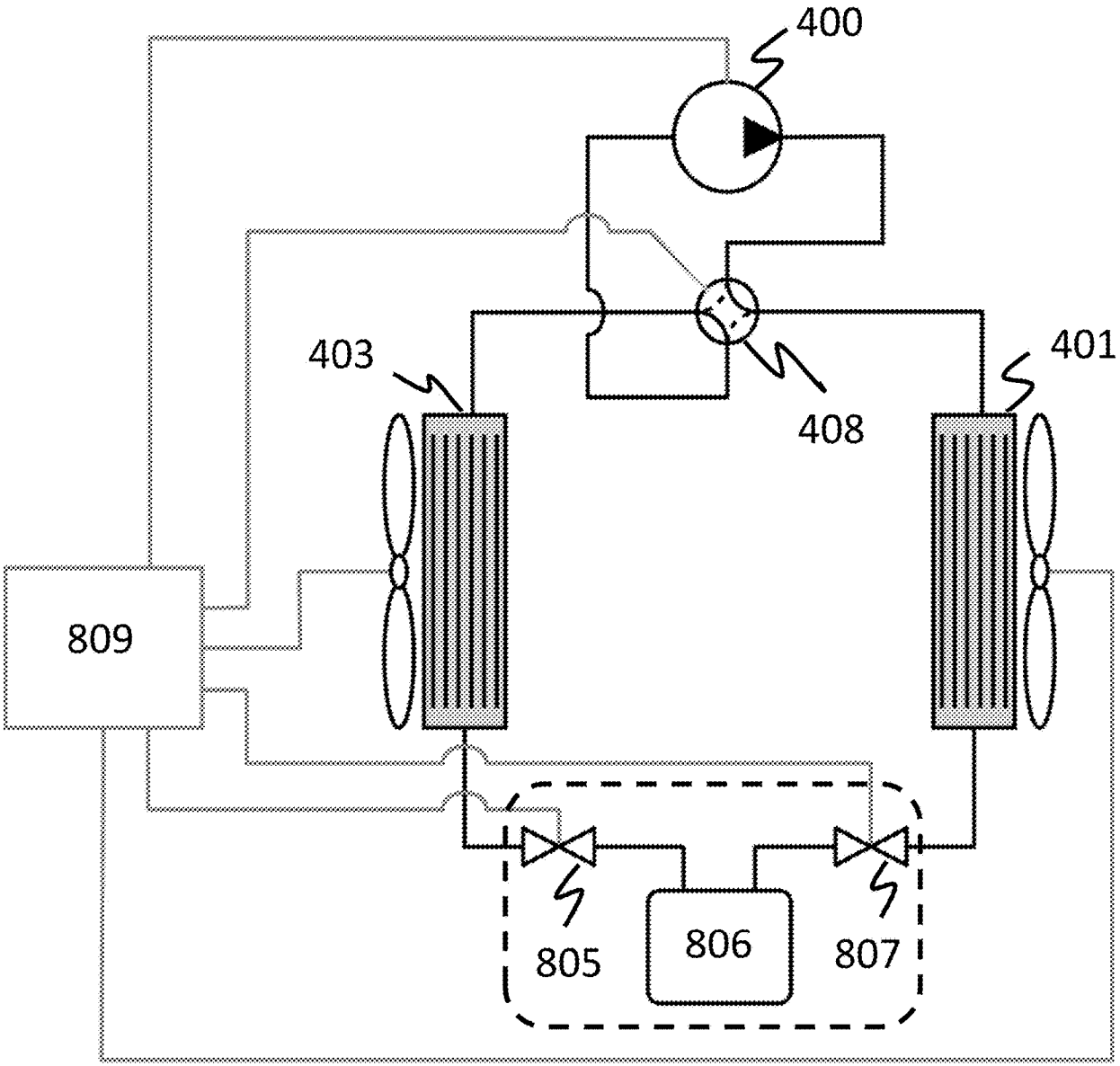

FIG. 8 shows a block diagram of the VCS according to another embodiment of the invention, in which the variable position expansion device 402, which is not part of the system 407, is eliminated. The elimination of the expansion device 402 can be desirable from a cost-saving perspective.

In this embodiment, the expansion device of the refrigerant management system 120 regulates both the amount of the refrigerant in the vapor compression cycle and a total pressure drop between the heat exchangers 401 and 403, such that the entire amount of the refrigerant in the vapor compression cycle passes through the expansion device during each vapor compression cycle. The performance of such a system can be affected by the fact that the storage vessel 806 and the two variable position expansion devices 805 and 807 regulate both the amount of the refrigerant and the total pressure drop between the two heat exchangers 401 and 403. In addition, this embodiment prevents the possibility of completely closing off the storage vessel from the remainder of the cycle. To that end, the controller 809 maintains the orifices of the first and the second expansion devices to ensure a constant flow of the refrigerant between the vapor compression cycle and the storage vessel.

Figure 9:
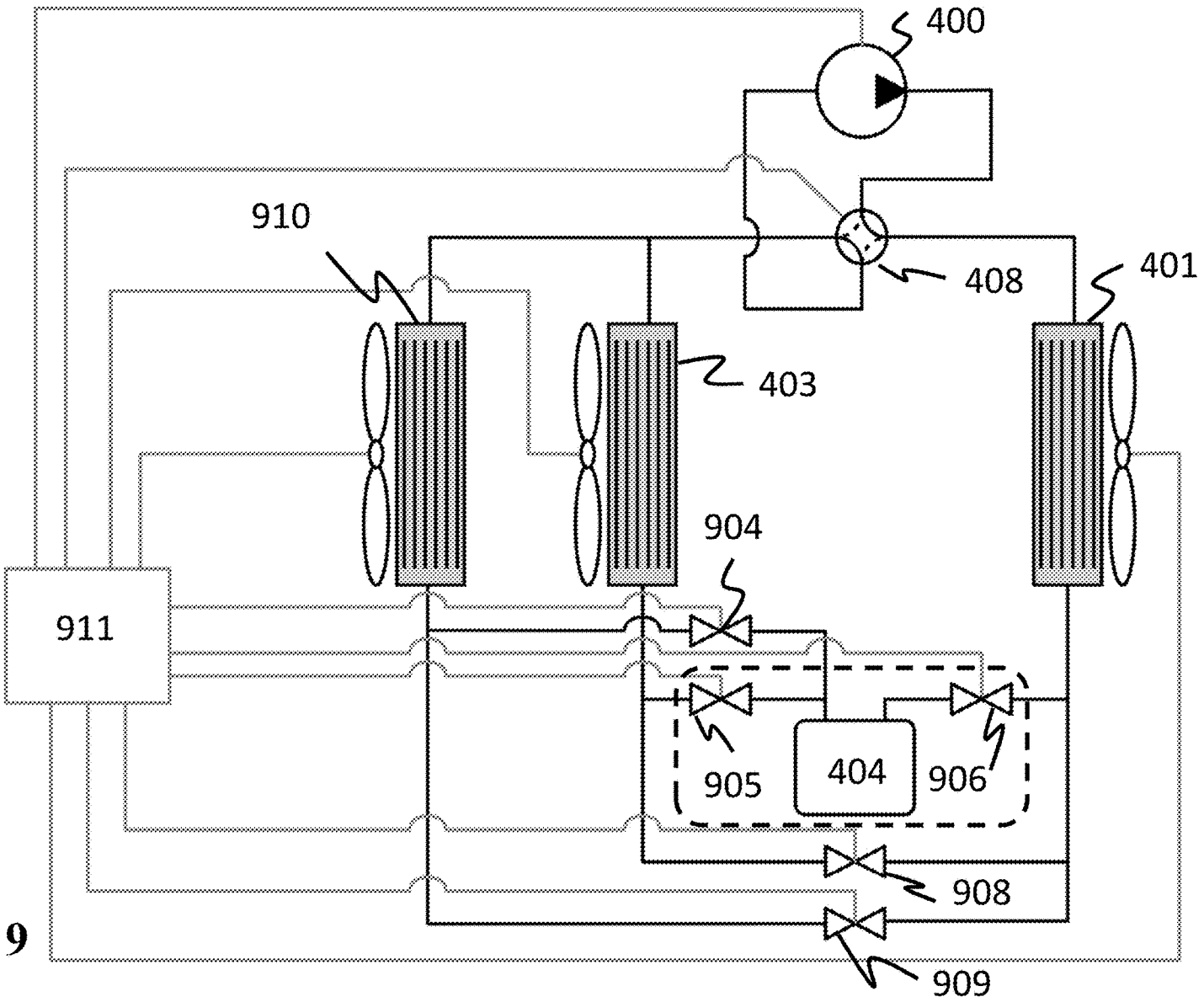

FIG. 9 shows a block diagram of the VCS according to another embodiment of the invention having an increased number of heat exchangers. This embodiment includes the additional evaporating heat exchanger 910 so that two separate spaces can be conditioned, rather than just one. As a result, the complexity of the storage vessel for this system is higher because three variable position expansion devices 904, 905, 906 are needed. The controller 911 additionally controls the extra heat exchanger 910 and the extra variable position expansion device 908 and 909.

The above-described embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Also, the various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine. Typically, the functionality of the program modules may be combined or distributed as desired in various embodiments.

Also, the embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

We claim:

1. A vapor compression system (VCS), comprising:

a heat transfer system (HTS) having an arrangement of components including a variable speed compressor for moving a refrigerant through a vapor compression cycle to condition a controlled environment;

a refrigerant management system including an expansion device regulating an amount of the refrigerant in the vapor compression cycle and in a storage vessel storing a balance of the refrigerant outside of the vapor compression cycle; and a controller including a processor configured to execute instructions stored in a memory to concurrently control a mass flow rate into and out of the storage vessel by continuously varying an amount of refrigerant flowing through an orifice of the expansion device, and control a speed of the compressor, wherein the controller is configured to:

determine jointly control inputs for varying a size of the orifice of the expansion device and varying the speed of the compressor according to a metric of performance of the VCS that reduces an amount of energy consumption of the VCS, such that the size of the orifice of the expansion device and the speed of the compressor are interdependent, wherein the controller includes an extremum-seeking controller optimizing the metric of performance using a model-free gradient descent of the metric of performance; and control the VCS using the jointly determined control inputs.

2. The VCS of claim 1, wherein the arrangement of components includes a first heat exchanger and a second heat exchanger, and the expansion device regulates both the amount of the refrigerant in the vapor compression cycle and a total pressure drop between the first and the second heat exchangers, such that the entire amount of the refrigerant in the vapor compression cycle passes through the expansion device during each vapor compression cycle.

3. The VCS of claim 1, wherein the expansion device provides an uninterrupted continuous flow of the refrigerant to the components by moving the refrigerant through the vapor compression cycle to condition the controlled environment.

4. The VCS of claim 1, wherein the memory stores a function mapping the set of the control signals to a set of control inputs controlling at least the size of the orifice of the expansion device and the speed of the compressor, wherein the controller comprises:

a feedback regulator determining a set of control signals reducing an error between a set of setpoints and a corresponding set of measurements of an operation of the VCS;

and an optimization controller updating the function in response to detecting a change in an operation of the VCS.

5. The VCS of claim 4, wherein the metric of performance is an energy consumption of the VCS, and the controller updates the function such that the operation of the VCS according to the set of control inputs reduces the energy consumption of the VCS.

6. The VCS of claim 1, wherein the refrigerant management system comprises:

a first expansion device of the at least one expansion device controlling a flow of the refrigerant from the vapor compression cycle into the storage vessel; and a second expansion device controlling a flow of the refrigerant from the storage vessel into the vapor compression cycle, wherein the controller changes a ratio of a size of an orifice of the first expansion device with respect to a size of an orifice of the second expansion device to control the amount of refrigerant in the vapor compression cycle.

7. The VCS of claim 6, wherein the size of the orifice of the first expansion device is fixed in an open position, such that the controller changes the size of the orifice of the second expansion device to regulate the amount of refrigerant.

8. The VCS of claim 6, wherein the controller maintains the orifices of the first and the second expansion devices to ensure a constant flow of the refrigerant between the vapor compression cycle and the storage vessel.

9. The VCS of claim 6, wherein the arrangement of components includes a first heat exchanger and a second heat exchanger for transferring heat in the controlled environment, and a third expansion device regulating a pressure drop between the first and the second heat exchangers, wherein the controller jointly optimizes a speed of the compressor, a size of an orifice of the third expansion device, and the ratio of the sizes of the orifices of the first and the second expansion devices.

10. A method for controlling an operation of a vapor compression system (VCS) including a heat transfer system (HTS) having an arrangement of components including a variable speed compressor for moving a refrigerant through a vapor compression cycle to condition a controlled environment and an expansion device regulating an amount of the refrigerant in the vapor compression cycle and in a storage vessel storing a balance of the refrigerant outside of the vapor compression cycle, wherein the method uses a processor coupled with stored instructions implementing the method, wherein the instructions, when executed by the processor carry out steps of the method, comprising:

determining jointly control inputs for varying a size of an orifice of the expansion device and varying the speed of the compressor according to a metric of performance of the VCS, such that joint operation of the expansion device and the compressor optimizes an energy consumption of the VCS, such that the size of the orifice of the expansion device and the speed of the compressor are interdependent; and controlling the VCS using the control inputs by concurrently controlling the speed of the compressor and a mass flow rate into and out of the storage vessel by continuously varying an amount of refrigerant flowing through the orifice of the expansion device.

11. The method of claim 10, wherein the VCS includes a refrigerant management system continuously regulating an amount of the refrigerant in the vapor compression cycle, wherein the expansion device includes a first expansion device controlling a flow of the refrigerant from the vapor compression cycle into the storage vessel and a second expansion device controlling a flow of the refrigerant from the storage vessel into the vapor compression cycle, the method further comprising:

changing a ratio of a size of an orifice of the first expansion device with respect to a size of an orifice of the second expansion device to control the amount of refrigerant in the vapor compression cycle.

12. The method of claim 11, wherein the ratio maintains the orifices of the first and the second expansion devices to ensure a constant flow of the refrigerant between the vapor compression cycle and the storage vessel.

13. A vapor compression system (VCS), comprising:

a heat transfer system (HTS) including an arrangement of components moving a refrigerant through a vapor compression cycle to condition a controlled environment, the HTS comprising:

a variable speed compressor for compressing the refrigerant;

a first heat exchanger and a second heat exchanger for transferring heat in the controlled environment; and a first expansion device regulating a pressure drop between the first and the second heat exchangers;

a refrigerant management system continuously regulating an amount of the refrigerant in the vapor compression cycle, the refrigerant management system comprising:

a storage vessel storing a balance of the refrigerant outside of the vapor compression cycle;

a second expansion device controlling a flow of the refrigerant from the vapor compression cycle into the storage vessel; and a third expansion device controlling a flow of the refrigerant from the storage vessel into the vapor compression cycle; and a controller having a processor configured to execute instructions stored in a memory to continuously control a mass flow rate into and out of the storage vessel to control an unmeasured circulating refrigerant mass of the HTS, by varying an amount of refrigerant flowing through orifices of the first, second and third expansion devices, and jointly determines inputs that simultaneously and concurrently controls the HTS, in order to maintain a metric of performance that reduces an amount of energy consumption of the VCS, the controller is configured to:

receive operating parameters from the HTS;

determine jointly control inputs for controlling operations of varying a size of the orifice of the first expansion device, varying a size of the orifice of the second expansion device and varying a size of an orifice of the third expansion device, varying a speed of the compressor according to the metric of performance of the VCS, such that the size of the orifices of the first expansion device, the second expansion device or the third expansion device and the speed of the compressor are interdependent; and control the VCS using the control inputs, wherein the expansion device provides flow of refrigerant into a flow of circulating refrigerant so as not to break a continuous flow of passage of the circulating refrigerant to the components of the vapor compression cycle.

14. The VCS of claim 13, wherein the controller comprises:

a feedback regulator determining a set of control signals reducing an error between a set of setpoints and a corresponding set of measurements of an operation of the VCS;

a memory storing a function mapping the set of the control signals to a set of control inputs controlling at least a speed of the compressor, and orifices of the first, the second and the third expansion devices; and an optimization controller updating the function to optimize a metric of performance of the VCS.

15. The VCS of claim 14, wherein the optimization controller includes an extremum-seeking controller optimizing the metric of performance using a model-free gradient descent of the metric of performance.

* * * * *